US007419109B1

(12) United States Patent
Ronfeldt et al.

(10) Patent No.: US 7,419,109 B1
(45) Date of Patent: Sep. 2, 2008

(54) APPARATUS FOR ATTACHING HAMMERS TO A HAMMER MILL

(75) Inventors: Ron R. Ronfeldt, Harlan, IA (US); Todd K Plumb, Harlan, IA (US); Christine D Petersen, Harlan, IA (US)

(73) Assignee: Jacobs Corporation, Harlan, IA (US)

( * ) Notice: Subject to any disclaimer, the term of this patent is extended or adjusted under 35 U.S.C. 154(b) by 80 days.

(21) Appl. No.: 11/531,100

(22) Filed: Sep. 12, 2006

(51) Int. Cl.
*B02C 13/04* (2006.01)

(52) U.S. Cl. ..... 241/189.1; 241/194; 241/195

(58) Field of Classification Search ..... 241/189.1, 241/194, 195
See application file for complete search history.

(56) References Cited

U.S. PATENT DOCUMENTS 6,102,312 A * 8/2000 Aberle ..... 241/101.742
7,278,597 B2 * 10/2007 Fenton ..... 241/194

* cited by examiner

*Primary Examiner*—Mark Rosenbaum
(74) *Attorney, Agent, or Firm*—Sturm & Fix LLP

(57) ABSTRACT

An apparatus for mounting hammers to a hammer mill having at least one hammer provided for attachment to a hammer mill, the at least one hammer having an opening disposed in one end thereof corresponding to a pivot axis, the opening being of a first diameter. A sleeve having a central opening therein is operatively attached to the hammer mill, the sleeve being disposed in the opening in the one end of the at least one hammer. The sleeve has a first cylindrical outer surface with a second diameter, the second diameter being only slightly smaller than the first diameter of the opening in one end of the at least one hammer. The sleeve has a second cylindrical outer surface with a third diameter, the third diameter being larger than said second diameter. A shoulder on the sleeve extends from the second cylindrical outer surface to the third cylindrical outer surface. An annular groove is disposed in the first cylindrical outer surface. A snap ring is selectively disposed in the annular groove, the snap ring having an outer diameter which is larger than the second diameter, whereby the at least one hammer will be disposed between the shoulder and the snap ring. A second embodiment uses a compression ring with a groove in it, instead of using a snap ring.

8 Claims, 6 Drawing Sheets

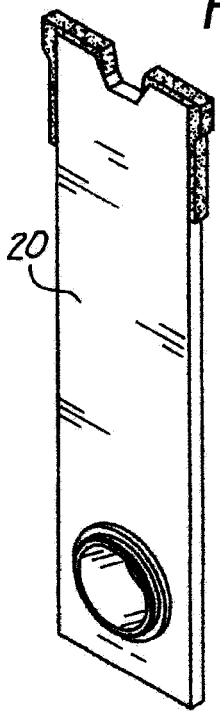
Fig. 5
Fig. 6
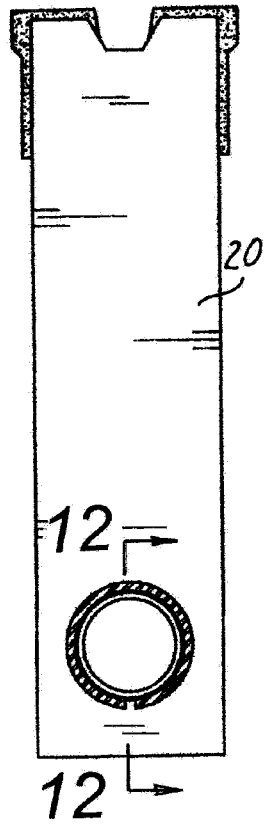
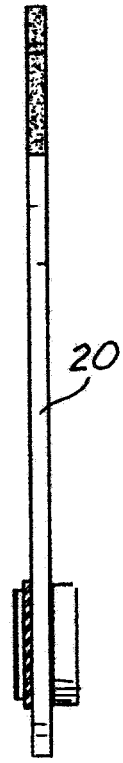
Fig. 7
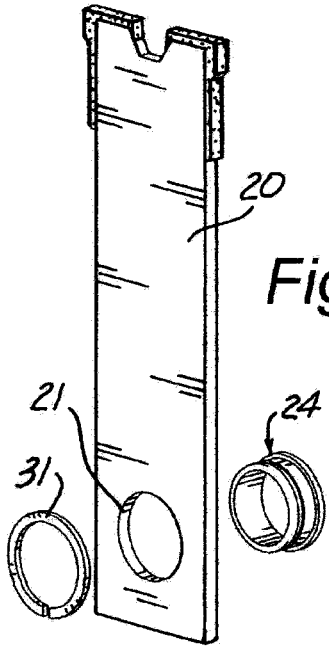
Fig. 8
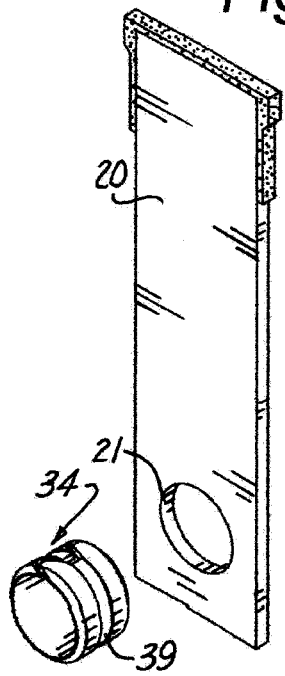
Fig. 9

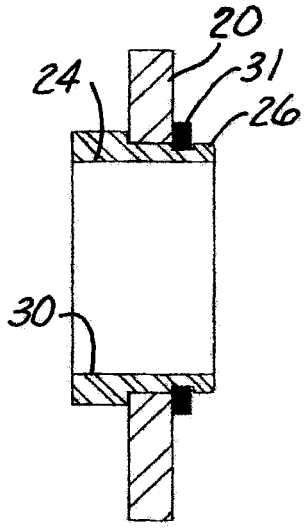
Fig. 12
Fig. 13
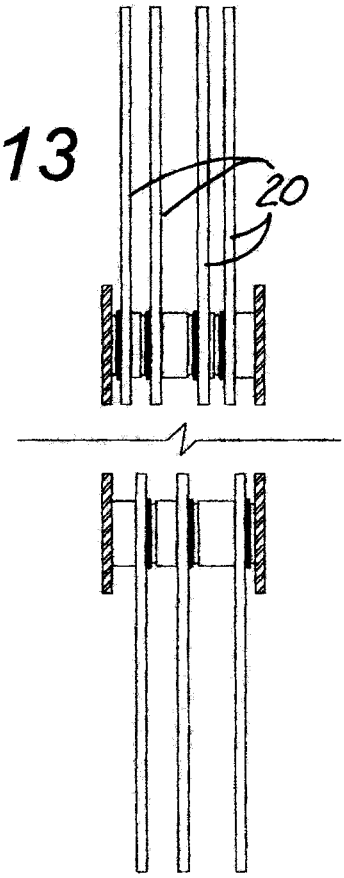
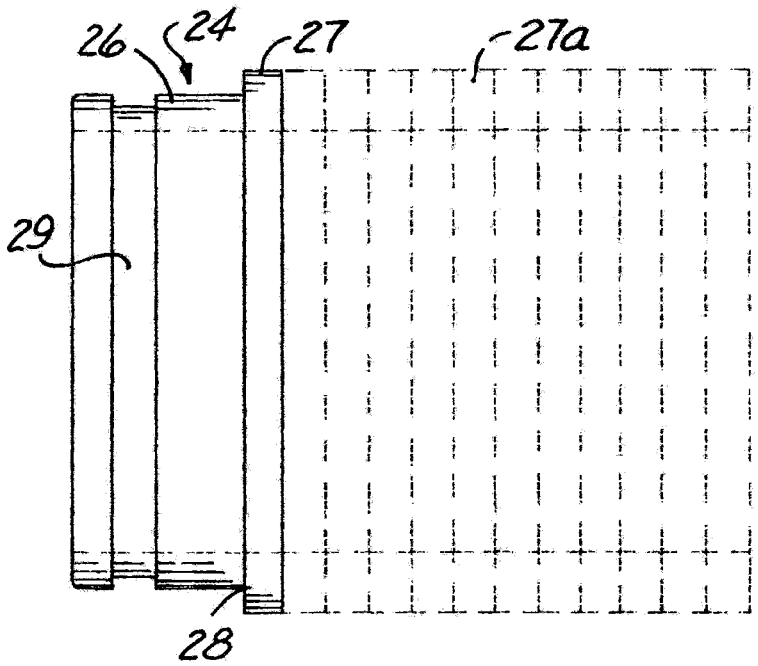
Fig. 14

APPARATUS FOR ATTACHING HAMMERS TO A HAMMER MILL

BACKGROUND OF THE INVENTION

1. Field of the Invention

The present invention relates to hammer mills and more particularly to an improved apparatus for attaching hammers to hammer mills.

2. Description of the Prior Art

Standard hammers, when grinding product in a hammer mill, impact product to be pulverized to create a smaller size. This impact forces product against a perforated screen area that also cuts and sizes the product. Because there are high impact forces on the hammers, this force is transmitted to a rotary connection between each hammer and the hammer mill. Premature failure of this pivotal connection between a hammer and the hammer mill will cause the entire hammer mill to be shut down for repair, which is a costly delay.

Accordingly there is a need for a hammer connecting apparatus to overcome the aforementioned problem.

BRIEF SUMMARY OF THE INVENTION

The present invention relates generally to an apparatus for mounting hammers to a hammer mill and more particularly to an improved apparatus for such purpose. At least one hammer is provided for attachment to a hammer mill, the at least one hammer having an opening disposed in one end thereof corresponding to a pivot axis, the opening being of a first diameter. A sleeve having a central opening therein is operatively attached to the hammer mill, the sleeve being disposed in the opening in the one end of the at least one hammer. The sleeve has a first cylindrical outer surface with a second diameter, the second diameter being only slightly smaller than the first diameter of the opening in one end of the at least one hammer. The sleeve has a second cylindrical outer surface with a third diameter, the third diameter being larger than said second diameter. A shoulder on the sleeve extends from the second cylindrical outer surface to the third cylindrical outer surface. An annular groove is disposed in the first cylindrical outer surface. A snap ring is selectively disposed in the annular groove, the snap ring having an outer diameter which is larger than the second diameter, whereby the at least one hammer will be disposed between the shoulder and the snap ring.

Therefore, an object of the present invention is to provide a device for more quickly and more securely attaching a hammer to a hammer mill.

Other objects, advantages, and novel features of the present invention will become apparent from the following detailed description of the invention when considered in conjunction with the accompanying drawings.

BRIEF DESCRIPTION OF THE SEVERAL VIEWS OF THE DRAWINGS

FIG. 5 is a perspective view of a preferred embodiment hammer of the present invention; and FIG. 6 is a side view of the attaching mechanism on a hammer;

FIG. 7 is a side elevational view of the embodiment of FIGS. 5 and 6;

FIG. 8 is an exploded view of the embodiment of FIGS. 5 and 6;

FIG. 9 is an exploded perspective view of a second embodiment of the invention;

FIG. 12 is a cross sectional view taken along line 12-12 of FIG. 6;

FIG. 13 is a cross sectional view showing how the embodiment of FIG. 12 is used to pivotally mount the hammers to the hammer mill in a proper spaced relationship;

FIG. 14 is a side elevational view of the embodiment of FIGS. 5-8 and showing in dashed lines how the second cylindrical surface can be made to be larger or smaller as needed to rotatably or pivotally mount the hammers in the way shown in FIG. 11.

DETAILED DESCRIPTION OF THE BEST MODES OF THE INVENTION

Figure 1:
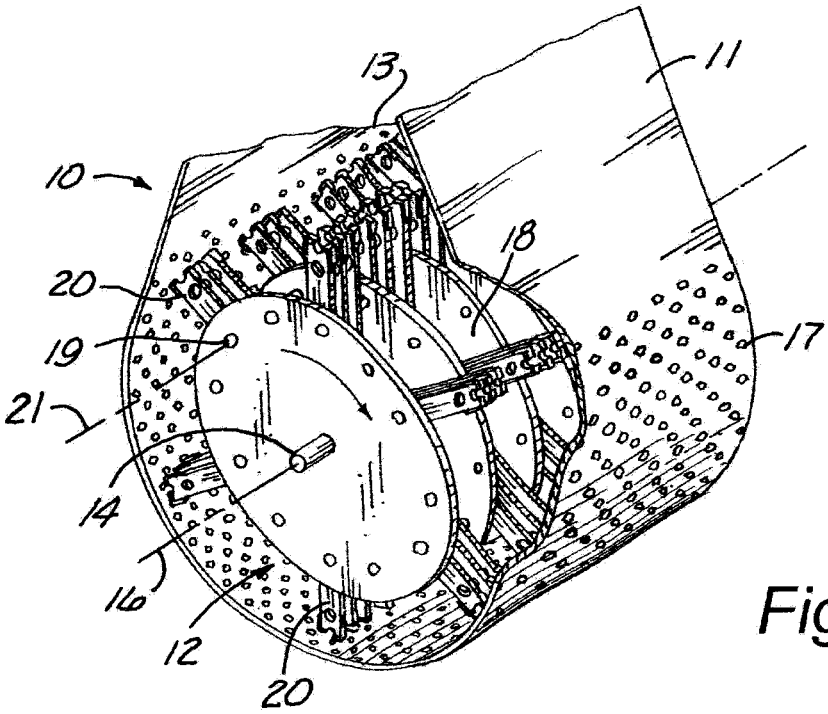
FIG. 1 is a perspective view of screen and rotor portions of a hammer mill constructed in accordance with the present invention.
Figure 2:
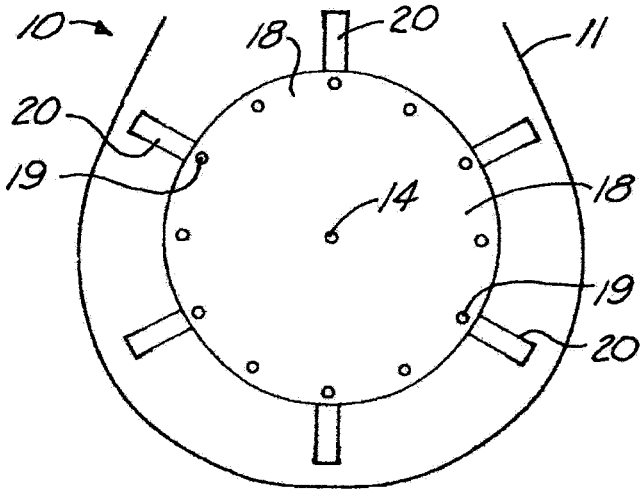
FIG. 2 is a front elevational view of the hammer mill shown in FIG. 1, but with a portion of the screen cut away to show the rotor and hammers.

Referring now to the drawings, where like reference numbers designate identical or corresponding views throughout the several views, FIG. 1 shows a hammer mill apparatus 10 constructed in accordance with the present invention.

The hammer mill apparatus 10 includes a housing 11 defining a hammer mill chamber 12 having an inlet 13. A rotor 14 is journaled in the housing 11 centrally of the housing hammer mill chamber 12 for rotation about a rotor axis 16. The rotor axis 16 extends through at least a portion of the chamber 12.

A screen is formed by having a plurality of openings 17 in the housing 11 radially outwardly of the rotor 14. The rotor 14 also includes a plurality of plates 18 rigidly attached thereto. Rods 19 are connected to each one of the plates 18 for rotatably attaching hammers 20 thereto.

The rotor 14 has a plurality of hammers 20 disposed in a hammer mill style and also being disposed in groups spaced circumferentially of the rotor 14. The hammers 20 of each group of hammers have a common pivot axis 21 that extends transversely of the rotor 14. Each of the pivot axes 21 is spaced respectively equidistantly radially outwardly of the rotor axis 16. The hammers 20 each are proportioned lengthwise thereof for hammer mill style cooperation with the screen upon rotation of the rotor 14. The rotor 14 is rotatable about its journaling axis 16 for grinding and screening through the screen for passage to the housing outlet (not shown) of material to be reduced in size that is introduced into the housing inlet 13. The material can be any material, but corn is a common material that is processed in a hammer mill. This apparatus 10 is similar to that shown in U.S. patent application Ser. No. 11/123,667 to Plumb, filed May 6, 2005, which patent application is incorporated herein in its entirety.

Figure 15:
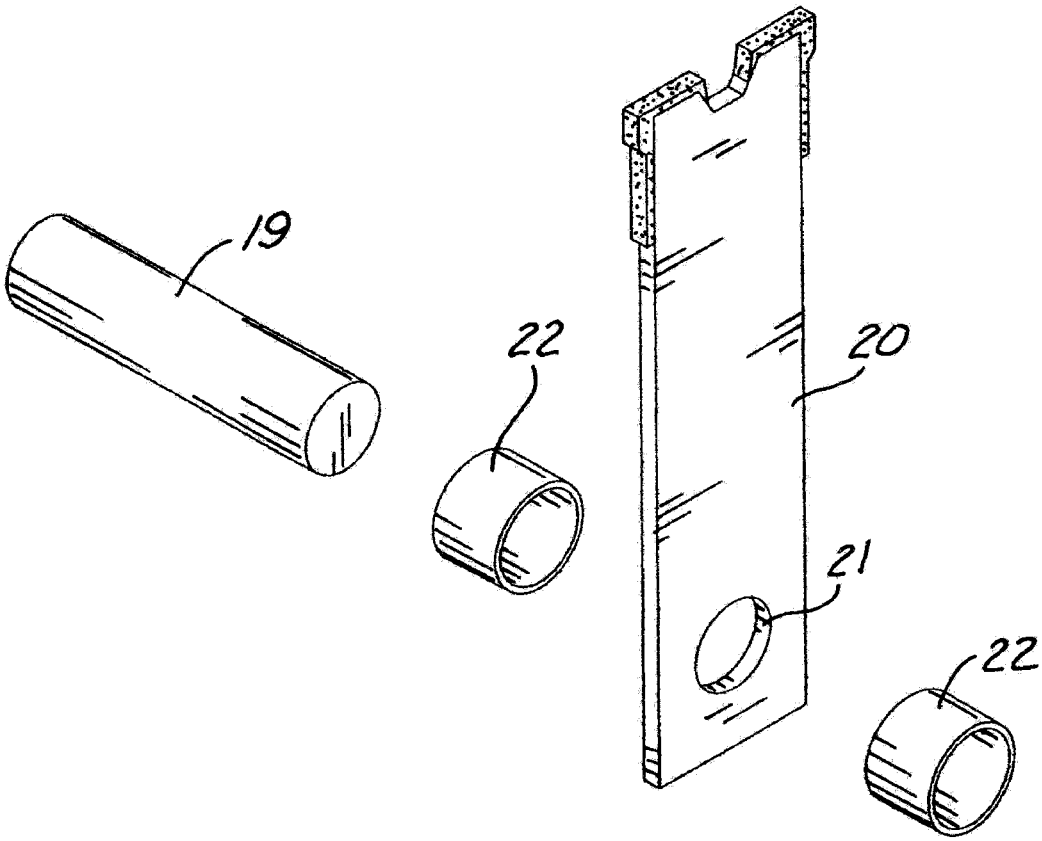
Fig. 15 Prior Art
FIG. 15 is an exploded view of a prior art mounting system for hammers.

FIG. 15 shows the prior art mounting arrangement for hammers wherein a shaft 19 extends through an opening 21 and through sleeves 22 wherein the opening 21 and the opening in the sleeves 22 are both the same and just slightly larger than the outside diameter of the shaft 19 so the hammer 20 is trapped between the two sleeves 22 and rotates freely on shaft 19. While this arrangement has been used for decades, it creates a lot of wear and tear on the parts rubbing against each other leading to eventual failure requiring replacement or repair of the parts.

The present invention as shown in FIGS. 5-8 and 12-14 show a sleeve 24 having a first outer cylindrical surface 26 having a diameter which is smaller than the outer diameter of a second cylindrical surface 27. A shoulder 28 is disposed between the first outer cylindrical surface 26 and the second cylindrical surface 27.

Figure 3:
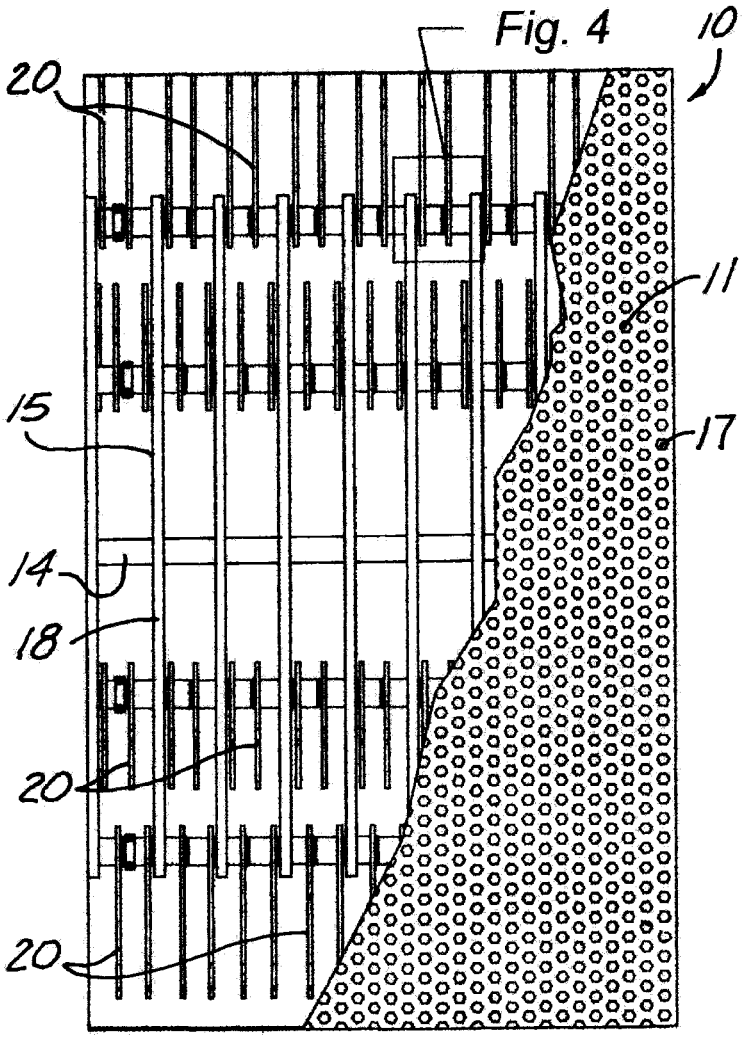
FIG. 3 is a side elevational view of the screen and rotor portions of the hammer mill of FIGS. 1 and 2.
Figure 4:
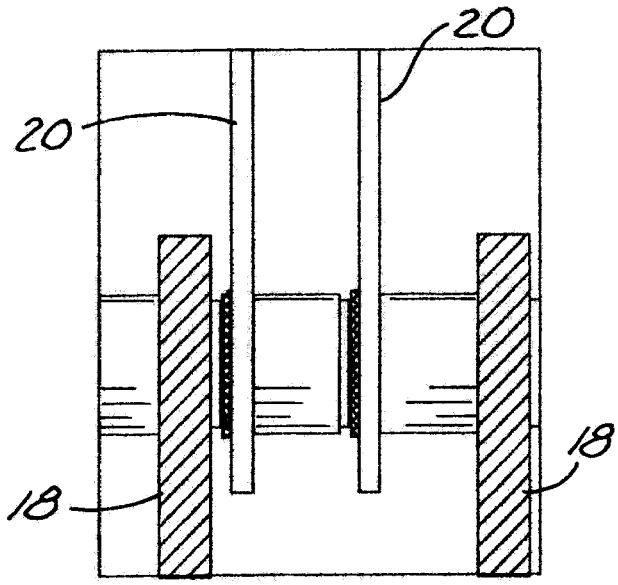
FIG. 4 is a cross sectional view of a preferred embodiment showing the present invention attaching a hammer to a hammer mill.
Figure 11:
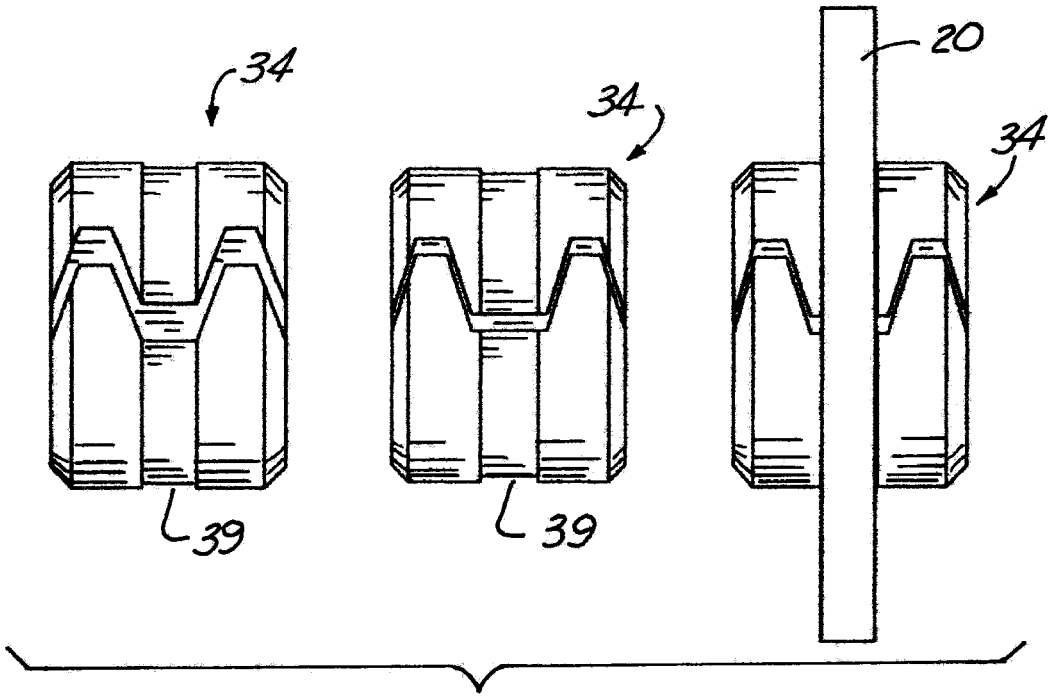
FIG. 11 is a side view of the compression ring of FIG. 10 showing it in its relaxed position on the left, in its compressed position in the middle that makes it small enough to fit in the opening in the hammer and in its somewhat compressed position wherein it is in a compression fit against the inner periphery of the opening in the hammer.

An annular groove 29 is disposed in the first cylindrical surface 26 to hold the hammer 20 on the sleeve 24 which is rotatably mounted on the shaft 19. An inner opening 30 is only slightly larger in diameter than the outer diameter of the shaft 19 so that several of the hammers 20 can be mounted on each shaft 19 as shown in FIGS. 3, 4 and 11. The hammers 20 can be spaced apart by making width of the second cylindrical surface wider or thinner as shown by segments 27*a* in FIG. 14 which shows in solid lines a narrow version of the sleeve 24, but in dashed lines how the width of the second cylindrical surface 24 can be widened by any chosen number of additional segments 27*a*. This is not to imply that the segments 27 are necessarily made from different pieces of metal, but merely to show how the width of the second cylindrical surface can be incrementally widened or narrowed to provide the spacing of the hammers as shown in the examples of FIGS. 3, 4 and 13. Using this present invention instead of the prior art shown in FIG. 15 significantly increases the life of the hammers and mounting accessories.

To explain how the assembly is completed on compression ring of FIG. 9, the compression ring 34 has an outward pressure when installed into opening 21 on hammer 20, thus a compression force is applied equally around the outside diameter of the insert to the walls of opening 21 of hammer 20. The recessed groove 39 on the outside of the compression ring is machined to accept the hammer mill hammer 20 and hold it after compression is released in a finite location. The locations of the hammer 20 can be changed by machining the groove 39 different distances from the ends of the compression ring 34.

Figure 10:
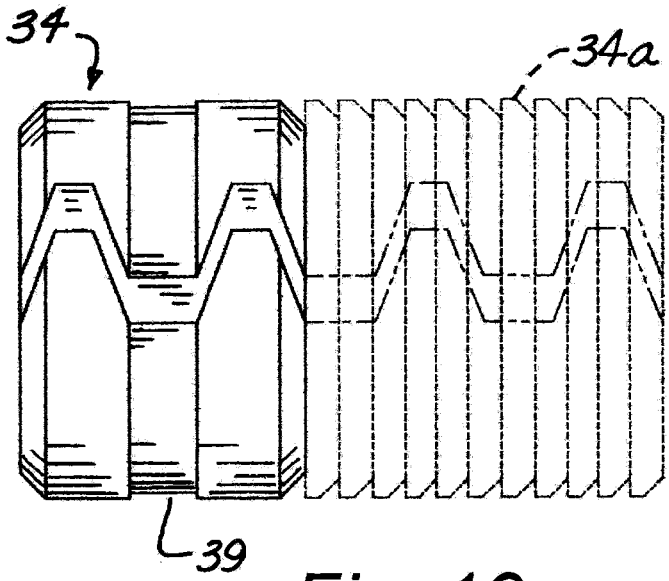
FIG. 10 is a side view of an compression ring embodiment of the present invention and showing in dashed lines how it can have extra sections to make it longer or shorter as desired to adjust the desired distance between adjacent hammers.

FIG. 10 shows a side view of a compression ring embodiment 34 of the present invention, showing in dashed lines how it can have extra sections 34*a* to make it longer or shorter as desired to adjust the desired distance between adjacent hammers 20;

FIG. 11 shows a side view of the compression ring 34 of FIG. 10 showing it in its relaxed position on the left, in its compressed position in the middle that makes it small enough to fit in the opening in the hammer and in its somewhat compressed position wherein it is in a compression fit against the inner periphery of the opening 21 in the hammer 20;

The basic difference between the sleeve 24 that uses a retaining ring 31 and the embodiment of FIG. 9 that uses a compression ring 34 is that the design of the retaining ring 24 insert allows the hammer to rotate on the insert and the insert to rotate on the hammer mill shaft 19, whereas the compression insert 34 of FIG. 9 will only rotate on the hammer mill shaft 19 and is fixed with respect to the hammer mill hammer 20. In other words, the retaining ring insert 24 rotates with respect to both the hammer 20 and with respect to the shaft 19, whereas the compression ring 34 only rotates about the shaft 19 and is essentially fixed with respect to the hammer 20 so that the hammer 20 and compression ring 34 rotate together about the shaft 19.

Accordingly, it will be appreciated that the preferred embodiments do indeed accomplish the aforementioned objects. Obviously many modifications and variations of the present invention are possible in light of the above teachings. It is therefore to be understood that, within the scope of the appended claims, the invention may be practiced otherwise than as specifically described.

We claim:

1. An apparatus for attaching hammers to a hammer mill, said apparatus comprising:

at least one hammer for a hammer mill, said at least one hammer having an opening disposed in one end thereof corresponding to a pivot axis, said opening being of a first diameter;

a sleeve having a central opening therein being operatively attached to the hammer mill, the sleeve being disposed in said opening in the one end of the at least one hammer;

said sleeve having a first cylindrical outer surface having a second diameter, said second diameter being only slightly smaller than the first diameter of the opening in one end of the at least one hammer;

said sleeve having a second cylindrical outer surface having a third diameter, said third diameter being larger than said second diameter;

a shoulder extending from the second cylindrical outer surface to the third cylindrical outer surface;

an annular groove disposed in the first cylindrical outer surface; and a snap ring being selectively disposed in the annular groove, said snap ring having an outer diameter which is larger than the second diameter, where by the at least one hammer will be disposed between the shoulder and the snap ring.

2. The apparatus of claim 1 including a shaft extending through the central opening in the sleeve for permitting the hammer to pivot about said pivot axis.

3. The apparatus of claim 1 wherein the second cylindrical surface of the sleeve is adjustable in length.

4. In a hammer mill that includes a housing defining a hammer mill chamber and an outlet therefrom, a rotor journaled in the housing centrally of the housing hammer mill chamber for rotation about a rotor axis that extends through at least a portion of the chamber, a screen mounted within the housing radially outwardly of the rotor, the rotor having a plurality of hammers disposed in a hammer mill style and disposed in groups spaced circumferentially of the rotor and rotatable about respective shaft, the hammers of each group of hammers having a common pivot axis that extends transversely of the rotor and each of said pivot axes being spaced respectively equidistantly radially outwardly of the rotor axis, the hammers each being proportioned lengthwise thereof for hammer mill style cooperation with the screen upon rotation of the rotor, the rotor being rotatable about its journaling axis for grinding and screening through the screen for passage to the housing outlet of material to be reduced in size that is introduced into the housing inlet, the improvement comprising:

at least one of the hammers comprising an opening disposed in one end thereof corresponding to said common pivot axis and being of a first diameter;

a sleeve having a central opening therein being operatively attached to the hammer mill, the sleeve being disposed in said opening in the one end of the at least one hammer;

said sleeve having a first cylindrical outer surface having a second diameter, said second diameter being only slightly smaller than the first diameter of the opening in one end of the at least one hammer;

said sleeve having a second cylindrical outer surface having a third diameter, said third diameter being larger than said second diameter;

a shoulder extending from the second cylindrical outer surface to the third cylindrical outer surface;

an annular groove disposed in the first cylindrical outer surface; and a snap ring being selectively disposed in the annular groove, said snap ring having an outer diameter which is larger than the second diameter, where by the at least one hammer will be disposed between the shoulder and the snap ring.

5. The apparatus of claim 4 including a shaft extending through the central opening in the sleeve.

6. The apparatus of claim 4 wherein the second cylindrical surface of the sleeve is adjustable in length.

7. In a hammer mill that includes a housing defining a hammer mill chamber and an outlet therefrom, a rotor journaled in the housing centrally of the housing hammer mill chamber for rotation about a rotor axis that extends through at least a portion of the chamber, a screen mounted within the housing radially outwardly of the rotor, the rotor having a plurality of hammers disposed in a hammer mill style and disposed in groups spaced circumferentially of the rotor, the hammers of each group of hammers having a common pivot axis disposed about a shaft that extends transversely of the rotor and each of said pivot axes being spaced respectively equidistantly radially outwardly of the rotor axis, the hammers each being proportioned lengthwise thereof for hammer mill style cooperation with the screen upon rotation of the rotor, the rotor being rotatable about its journaling axis for grinding and screening through the screen for passage to the housing outlet of material to be reduced in size that is introduced into the housing inlet, the improvement comprising:

at least one of the hammers having an opening therein, the opening in the at least one hammer having an inner peripheral wall;

a compression ring having a central opening is disposed on the shaft for rotation about the shaft the compression ring being disposed in said opening the at least one hammer in a compression fit with the inner peripheral wall of the hammer;

said compression ring having a first cylindrical outer surface having a first diameter, said first diameter being present when the ring is not compressed and a second diameter when the compression ring is compressed, the second diameter being smaller than the first diameter in the compressed condition whereby the compression ring can be compressed, placed in the opening in the at least one hammer, at which time the compression is released and the compression ring will be in compression contact with the inner periphery of the opening of the at least one hammer; and a groove disposed in the first cylindrical outer surface and wherein the inner peripheral wall of the opening in the at least one hammer is disposed in the groove when the compression ring is attached to the at least one hammer.

8. The apparatus of claim 7 whereby the shaft extends through the central opening in the compression ring so that the at least one hammer and compression ring are disposed for rotation together about the shaft.

* * * * *